US010305168B2

(12) United States Patent
Liu et al.

(10) Patent No.: US 10,305,168 B2
(45) Date of Patent: May 28, 2019

(54) ANTENNA ASSEMBLY AND ELECTRONIC DEVICE

(71) Applicant: Beijing Xiaomi Mobile Software Co., Ltd., Beijing (CN)

(72) Inventors: Wendong Liu, Beijing (CN); Wei Kuang, Beijing (CN); Xu Zhang, Beijing (CN)

(73) Assignee: Beijing Xiaomi Mobile Software Co., Ltd., Beijing (CN)

( * ) Notice: Subject to any disclaimer, the term of this patent is extended or adjusted under 35 U.S.C. 154(b) by 96 days.

(21) Appl. No.: 15/414,943

(22) Filed: Jan. 25, 2017

(65) Prior Publication Data

US 2017/0222305 A1 Aug. 3, 2017

(30) Foreign Application Priority Data

Jan. 29, 2016 (CN) ..... 2016 1 0064948

(51) Int. Cl.

| | |
|---|---|
| ***H01Q 1/38*** | (2006.01) |
| ***H01Q 1/24*** | (2006.01) |
| ***H01Q 21/30*** | (2006.01) |
| ***H01Q 13/10*** | (2006.01) |
| ***H01Q 1/48*** | (2006.01) |

(52) U.S. Cl.

CPC ..... *H01Q 1/243* (2013.01); *H01Q 1/38* (2013.01); *H01Q 1/48* (2013.01); *H01Q 13/10* (2013.01); *H01Q 21/30* (2013.01)

(58) Field of Classification Search

CPC ..... H01Q 1/243; H01Q 13/10; H01Q 1/38; H01Q 21/30; H01Q 1/48

USPC ..... 343/700 MS, 702

See application file for complete search history.

(56) References Cited

U.S. PATENT DOCUMENTS

| | | | | |
|---|---|---|---|---|
| 9,203,456 | B2 * | 12/2015 | Teng | H01Q 5/35 |
| 2013/0027254 | A1 | 1/2013 | Korva et al. | |
| 2013/0050038 | A1 | 2/2013 | Eom et al. | |

(Continued)

FOREIGN PATENT DOCUMENTS

| | | | |
|---|---|---|---|
| CN | 103236583 | A1 | 8/2013 |
| CN | 104269609 | A1 | 1/2015 |

(Continued)

OTHER PUBLICATIONS

Extended European Search Report issued in corresponding EP Application No. 17153128, dated Jun. 21, 2017, 9 pages.

(Continued)

*Primary Examiner* — Hai V Tran

(74) *Attorney, Agent, or Firm* — Arch & Lake LLP

(57) ABSTRACT

The present disclosure relates to an antenna assembly and an electronic device in the field of antennas. The antenna assembly includes: a first antenna, a second antenna and a metal frame. The metal frame includes: a metal plate; and a first side frame, a second side frame, a top frame and a bottom frame which enclose the metal plate. The first antenna is connected to a first radiation part of the bottom frame via a first connection point, the first radiation part being connected to the first side frame which is separated from the metal plate by a slot. The second antenna is connected to a second radiation part of the bottom frame via a second connection point, the second radiation part being disconnected from the first radiation part and the second side frame.

19 Claims, 4 Drawing Sheets

(56) References Cited

U.S. PATENT DOCUMENTS

| | | | | |
|---|---|---|---|---|
| 2014/0078008 | A1* | 3/2014 | Kang | H01Q 5/35 343/702 |
| 2014/0292584 | A1 | 10/2014 | Lin | |
| 2015/0349404 | A1 | 12/2015 | Wang | |

FOREIGN PATENT DOCUMENTS

| | | | |
|---|---|---|---|
| CN | 105006647 | A1 | 10/2015 |
| EP | 2562870 | A1 | 2/2013 |

OTHER PUBLICATIONS

International Search Report issued in corresponding PCT Application No. PCT/CN2016/102057, dated Dec. 28, 2016, 13 pages.

* cited by examiner

ANTENNA ASSEMBLY AND ELECTRONIC DEVICE

CROSS-REFERENCE TO RELATED APPLICATIONS

This application is filed based upon and claims priority of the Chinese Patent Application No. 2016100649482, filed on Jan. 29, 2016, the entire content of which is incorporated herein by reference.

TECHNICAL FIELD

The present disclosure is related to the field of antennas, and more particularly to an antenna assembly and an electronic device.

BACKGROUND

The carrier aggregation (CA) technology refers to a technology of aggregating multiple carriers into a broad frequency spectrum to facilitate increasing uplink and downlink transmission rates of mobile terminals.

To apply the CA technology to a mobile terminal, the mobile terminal may be provided with two antennas, one of which may operate at a medium and low frequency band and the other one may operate at a high frequency band. The antenna for the medium and low frequency band may be connected to a bottom frame of the mobile terminal, and may radiate an antenna signal via the bottom frame. The antenna for the high frequency band may be connected to a lower part of a side frame of the mobile terminal, and may radiate an antenna signal via the lower part of the side frame. However, when the mobile terminal is held in a user's hand (in a held-in-hand state), because the palm may contact the lower part of the side frame of the mobile terminal and the dielectric constant of the palm is relatively high, there may be a relatively large loss of current flowing through the lower part of the side frame, which may seriously affect the radiation efficiency of the antennas.

SUMMARY

Embodiments of the present disclosure provide an antenna assembly, an electronic device and a method as below.

According to a first aspect of the embodiments of the present disclosure, an antenna assembly is provided. The antenna assembly may include: a first antenna, a second antenna and a metal frame. The metal frame may include: a metal plate; and a first side frame, a second side frame, a top frame and a bottom frame which enclose the metal plate. The first antenna may be connected to a first radiation part of the bottom frame via a first connection point, the first radiation part being connected to the first side frame which may be separated from the metal plate by a slot. The second antenna may be connected to a second radiation part of the bottom frame via a second connection point, the second radiation part being disconnected from the first radiation part and the second side frame.

According to a second aspect of the embodiments of the present disclosure, an electronic device may be provided. The electronic device may include an antenna assembly that may include a first antenna, a second antenna and a metal frame. The metal frame may include: a metal plate; and a first side frame, a second side frame, a top frame and a bottom frame which enclose the metal plate. The first antenna may be connected to a first radiation part of the bottom frame via a first connection point, the first radiation part being connected to the first side frame which may be separated from the metal plate by a slot. The second antenna may be connected to a second radiation part of the bottom frame via a second connection point, the second radiation part being disconnected from the first radiation part and the second side frame.

According to a third aspect of the embodiments of the present disclosure, a method may be provided. The method may include providing an antenna assembly that may include a first antenna, a second antenna and a metal frame, where the metal frame may include: a metal plate; and a first side frame, a second side frame, a top frame and a bottom frame which enclose the metal plate; the first antenna is connected to a first radiation part of the bottom frame via a first connection point, the first radiation part being connected to the first side frame which is separated from the metal plate by a slot; and the second antenna is connected to a second radiation part of the bottom frame via a second connection point, the second radiation part being disconnected from the first radiation part and the second side frame.

The method may also include radiating, by the first radiation part, an antenna signal under the action of a first feed current that flows through the first antenna, flows into the first radiation part via the first connection point, and flows into the first side frame and the metal plate via the first radiation part; and radiating, by second radiation part, an antenna signal under the action of a second feed current that flows through the second antenna, flows into the second radiation part via the second connection point.

It should be understood that both the foregoing general description and the following detailed description are exemplary and explanatory only and are not restrictive of the disclosure.

BRIEF DESCRIPTION OF THE DRAWINGS

The accompanying drawings, which are incorporated in and constitute a part of this specification, illustrate embodiments consistent with the disclosure and, together with the description, serve to explain the principles of the disclosure.

Figure 1A:
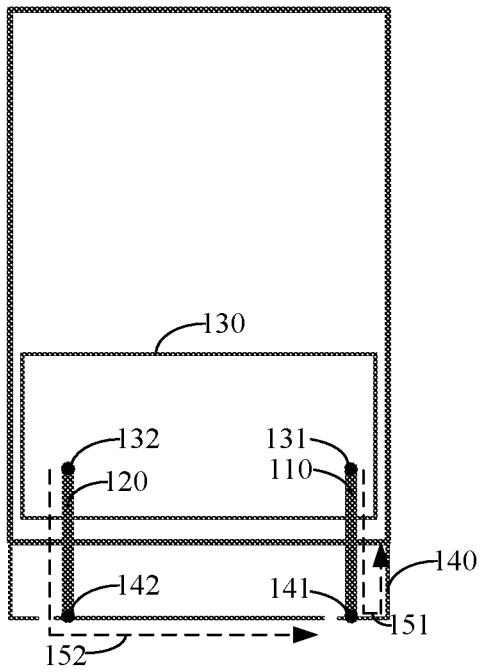
FIG. 1A is a schematic structural diagram of a conventional antenna assembly.

Skilled artisans will appreciate that elements in the figures are illustrated for simplicity and clarity and have not necessarily been drawn to scale. For example, the dimensions and/or relative positioning of some of the elements in the figures may be exaggerated relative to other elements to help to improve understanding of various examples of the present disclosure. Also, common but well-understood elements that are useful or necessary in a commercially feasible example are often not depicted in order to facilitate a less obstructed view of these various examples. It will further be appreciated that certain actions and/or steps may be described or depicted in a particular order of occurrence while those skilled in the art will understand that such specificity with respect to sequence is not actually required. It will also be understood that the terms and expressions used herein have the ordinary technical meaning as is accorded to such terms and expressions by persons skilled in the technical field as set forth above, except where different specific meanings have otherwise been set forth herein.

DETAILED DESCRIPTION

Reference will now be made in detail to embodiments, examples of which are illustrated in the accompanying drawings. The following description refers to the accompanying drawings in which the same numbers in different drawings represent the same or similar elements unless otherwise indicated. The implementations set forth in the following description of embodiments do not represent all implementations consistent with the disclosure. Instead, they are merely examples of apparatuses and methods consistent with aspects related to the disclosure as recited in the appended claims.

The terminology used in the present disclosure is for the purpose of describing exemplary examples only and is not intended to limit the present disclosure. As used in the present disclosure and the appended claims, the singular forms "a," "an" and "the" are intended to include the plural forms as well, unless the context clearly indicates otherwise. It shall also be understood that the terms "or" and "and/or" used herein are intended to signify and include any or all possible combinations of one or more of the associated listed items, unless the context clearly indicates otherwise.

It shall be understood that, although the terms "first," "second," "third," etc. may include used herein to describe various information, the information should not be limited by these terms. These terms are only used to distinguish one category of information from another. For example, without departing from the scope of the present disclosure, first information may include termed as second information; and similarly, second information may also be termed as first information. As used herein, the term "if" may include understood to mean "when" or "upon" or "in response to" depending on the context.

Reference throughout this specification to "one embodiment," "an embodiment," "exemplary embodiment," or the like in the singular or plural means that one or more particular features, structures, or characteristics described in connection with an example is included in at least one embodiment of the present disclosure. Thus, the appearances of the phrases "in one embodiment" or "in an embodiment," "in an exemplary embodiment," or the like in the singular or plural in various places throughout this specification are not necessarily all referring to the same embodiment. Furthermore, the particular features, structures, or characteristics in one or more embodiments may include combined in any suitable manner.

The technical solutions according to the embodiments of this disclosure may have the following advantageous effects. By providing a slot between the metal plate of the metal frame and the side frame, additional resonance can be produced at the slot by the side frame and the metal plate under the action of the feed current flowed thereinto, thereby improving the radiation performance of the antenna assembly. This solves the problem that: when the mobile terminal is in a held-in-hand state, because the palm will contact the lower part of the side frame of the mobile terminal, there will be a relatively large loss of current flowing through the lower part of the side frame, which seriously affects the radiation efficiency of the antennas. By generating additional resonance at the slot between the side frame and the metal plate of the metal frame, the otherwise concentrated radiation signals are dispersed, thereby achieving the effects of reducing the radiation signal loss at the held part in a held-in-hand state of the mobile terminal and improving the radiation efficiency of the antenna assembly.

The antenna assembly provided by embodiments of this disclosure may be used for mobile terminals such as smart phones, tablet computers, electronic book readers, MP3 players (Moving Picture Experts Group Audio Layer III) or MP4 (Moving Picture Experts Group Audio Layer IV) players. For facilitating description, the following embodiments are described by taking an example in which the antenna assembly is applied in a smart phone, which however does not limit this disclosure.

The mobile terminal is exemplified as a smart phone. To apply the carrier aggregation (CA) technology to the smart phone so as to increase the uplink and downlink transmission rates of the smart phone, the smart phone is provided with two antennas, whose positions are shown in FIG. 1A.

In FIG. 1A, an antenna 110 is electrically connected to a PCB 130 via a first feed point 131, and a second antenna 120 is electrically connected to the PCB 130 via a second feed point 132.

To improve the radiation capability of the antennas 110 and 120, the antenna 110 is connected to a metal frame 140 via a first connection point 141, and the antenna 120 is connected to the metal frame 140 via a second connection point 142. After flowing through the antenna 110 from the feed point 131, a feed current flows into the metal frame 140 via the first connection point 141, and the current path is shown by the dotted line 151. After flowing through the antenna 120 from the feed point 132, a feed current flows into the metal frame 140 via the second connection point 142, and the current path is shown by the dotted line 152. As the metal frame 140 radiates signals as a part of the antennas, the radiation performance of the smart phone is much better when the smart phone is not held in a user's hand, which may be called in a non-held-in-hand state.

Figure 1B:
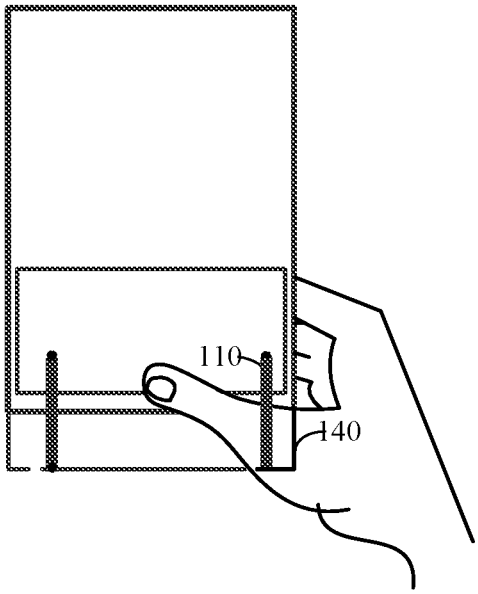
FIG. 1B is a schematic diagram showing a current path in the antenna assembly shown in FIG. 1A.

However, when the smart phone is held in a user's hand which may be called in a held-in-hand state (as shown in FIG. 1B), the lower part of a side frame of the metal frame 140 contacts a user's palm. As such, when the feed current flowing through the antenna 110 and flows into the lower part of the side frame of the metal frame 140, there may be a large loss of current, which may seriously affect the radiation performance of the antenna 110 and may result in low antenna radiation efficiency when the smart phone is in this held-in-hand state.

To solve the problem that the antenna radiation efficiency of the smart phone is low in the held-in-hand state, embodiments of the present disclosure provide an antenna assembly, by which the antenna radiation efficiency of the smart phone can be considerably improved in the held-in-hand state.

Figure 2A:
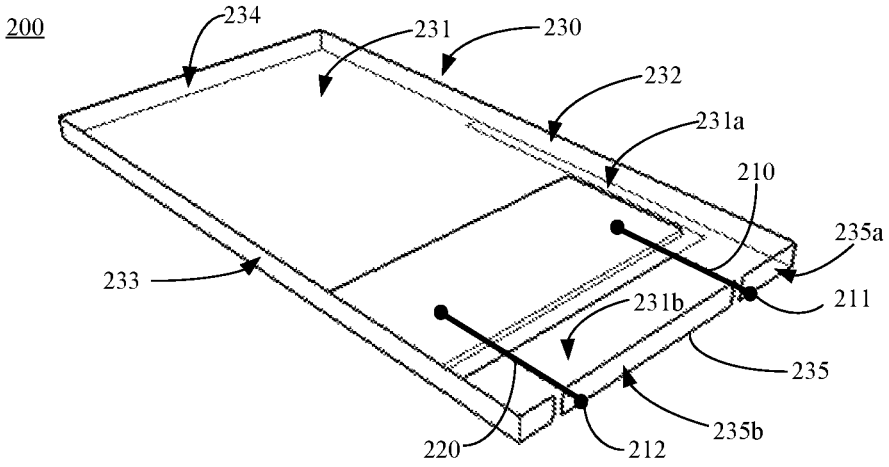
FIG. 2A is a perspective diagram of an antenna assembly according to an exemplary embodiment of this disclosure.

FIG. 2A is a perspective diagram of an antenna assembly 200 according to an exemplary embodiment of this disclosure.

The antenna assembly 200 may include a first antenna 210, a second antenna 220 and a metal frame 230. The metal frame 230 may include: a metal plate 231; and a first side frame 232, a second side frame 233, a top frame 234 and a bottom frame 235 which may enclose the metal plate 231.

The first antenna 210 is connected to a first radiation part 235*a* of the bottom frame 235 via a first connection point 211, the first radiation part 235*a* being connected to the first side frame 232 which is separated from the metal plate 231 by a slot 231*a*.

The second antenna 220 is connected to a second radiation part 235*b* of the bottom frame 235 via a second connection point 212, the second radiation part 235*b* being disconnected from the first radiation part 235*a* and the second side frame 233.

It should be noted that, in order to allow sufficient radiation of antenna signals by the first and second radiation parts 235*a* and 235*b*, a clearance area 231*b* is provided between the bottom frame 235 and the metal plate 231, so that antenna signals sent from the first and second radiation parts 235*a* and 235*b* can be sufficiently radiated at the clearance area 231*b*, and interference caused by the metal plate 231 to the antenna signals can be avoided.

Figure 2B:
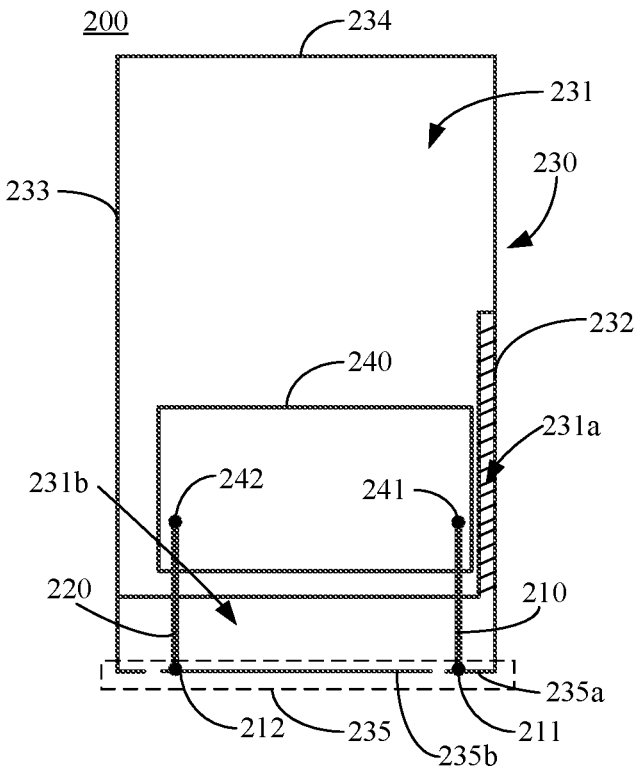
FIG. 2B is a schematic plan view of the antenna assembly shown in FIG. 2A.

FIG. 2B illustrates a schematic plan view of the antenna assembly 200 shown in FIG. 2A. Corresponding to the antenna assembly 200 shown in FIG. 2A, the antenna assembly 200 shown in FIG. 2B includes a first antenna 210, a second antenna 220 and a metal frame 230. In FIG. 2B, the metal frame 230 includes: a metal plate 231; and a first side frame 232, a second side frame 233, a top frame 234 and a bottom frame 235 which may enclose the metal plate 231.

One end of the first antenna 210 is connected to a first radiation part 235*a* of the bottom frame 235 via a first connection point 211, the first radiation part 235*a* being connected to the first side frame 232. The antenna assembly 200 differs from the antenna assembly 100 shown in FIG. 1A in that a slot 231*a* (hatched in FIG. 1A) is opened on the metal frame 230 between the first side frame 232 and the metal plate 231.

One end of the second antenna 220 is connected to a second radiation part 235*b* of the bottom frame 235 via a second connection point 212, the second radiation part 235*b* is disconnected from the first radiation part 235*a* by an opening between the first radiation part 235*a* and the second radiation part 235*b*, and the second radiation part 235*b* is disconnected from the second side frame 233 by another opening between the second radiation part 235*b* and the second side frame 233. In other words, the second radiation part 235*b* is independently arranged in the metal frame 230.

When the antenna assembly 200 is provided within an electronic device, the metal plate 231 further has a PCB 240 fixedly provided thereon. The other end of the first antenna 210 is electrically connected to the PCB 240 via the first feed point 241 for receiving a first feed current output by the PCB 240 via the first feed point 241. Similarly, the other end of the second antenna 220 is electrically connected to the PCB 240 via the second feed point 242 for receiving a second feed current output by the PCB 240 via the second feed point 242.

Both the first antenna 210 and the second antenna 220 may be made by metal or conductive materials such as copper or aluminum. The outside of the first antenna 210 and the second antenna 220 may be surrounded by an insulate layer which insulate the first antenna 210 and the second antenna 220 from surrounding components of the antenna assembly 200 which may include PCB 240 and/or metal plate 231. The insulate layer may be coded on the outside of the first antenna 210 and the second antenna 220 by using the insulation materials such as insulation paints. Alternatively, the insulate layer may be made of insulation materials such as plastic materials, and the insulate layer may be fixedly attached to the outside of the first antenna 210 and the second antenna 220 by surrounding both the first antenna 210 and the second antenna 220.

When the first antenna 210 works, the first feed current flowing through the first antenna 210 flows into the first radiation part 235*a* via the first connection point 211, and then flows into the first side frame 232 and the metal plate 231 via the first radiation part 235*a*, so that the first radiation part 235*a* radiates an antenna signal under the action of the first feed current. Similarly, the second feed current flowing through the second antenna 220 flows into the second radiation part 235*b* via the second connection point 212, so that the second radiation part 235*b* radiates an antenna signal under the action of the second feed current.

As the slot 231*a* exists between the first side frame 232 and the metal plate 231 and the first feed current flows into both the first side frame 232 and the metal plate 231, slot radiation (i.e., resonance) may be produced at the slot 231*a* between the first side frame 232 and the metal plate 231 under the action of the first feed current.

Compared with FIG. 1A in which the antenna radiation signals are concentrated at the bottom side frame and adjacent part of the side frames, when the antenna assembly in FIG. 2A works, the antenna radiation signals are dispersedly distributed over the first radiation part 235*a* and the second side frame 232 corresponding to the slot 231*a*, so that the radiation amount of the antenna signals in a unit length is reduced. Accordingly, when a mobile terminal is in a held-in-hand state, the total amount of radiation attenuation due to palm holding is reduced, thereby reducing the influence caused by hand holding to the radiation efficiency of the antenna assembly. In addition, additional resonance produced at the slot 231*a* can be utilized for antenna signal radiation, thereby further improving the radiation efficiency of the antenna assembly 200.

Corresponding to FIG. 2A, as shown in FIG. 2B, a clearance area 231*b* is provided between the bottom frame 235 and the metal plate 231, so that antenna signals corresponding to the first and second radiation parts 235*a*, 235*b* can be sufficiently radiated at the clearance area 231*b*, and interference to the antenna signal radiation due to blocking by the metal plate 231 can be avoided.

In a possible implementation, a length of the first radiation part 235*a* is less than that of the second radiation part 235*b*; the first radiation part 235*a* may be configured to radiate an antenna signal at a high frequency band, and the second radiation part 235*b* may be configured to radiate an antenna signal at a medium and low frequency band; the high frequency band may range from 2,300 MHz to 2,700 MHz, and the medium and low frequency band may range from 700 MHz to 2,100 MHz.

Accordingly, as the first radiation part 235*a* is configured to radiate an antenna signal at a high frequency band, the resonance produced at the slot 231*a* is also high-frequency resonance, which assists the first radiation part 235*a* in improving the radiation efficiency of the high-frequency antenna signal.

It should be noted that the resonance frequency of the resonance produced at the slot 231*a* is inversely proportional to a length of the slot 231*a*. That is, the longer the slot 231*a* is, the lower the resonance frequency of the resonance produced will be, and vice versa. In addition, the resonance bandwidth of the resonance produced at the slot 231*a* is proportional to a width of the slot 231*a*. That is, the wider the slot 231*a* is, the wider the resonance bandwidth of the produced resonance will be, and vice versa. When manufacturing the antenna assembly 200, the length and width of the slot 231*a* can be adjusted according to the actual needs, so that the radiation efficiency of the antenna assembly 200 at the high frequency band is higher, and carrier aggregation of the antenna signals can be facilitated.

According to the antenna assembly provided by the embodiments of this disclosure, by providing a slot between the metal plate of the metal frame and the side frame, additional resonance can be produced at the slot by the side frame and the metal plate under the action of the feed current flowed thereinto, thereby improving the radiation performance of the antenna assembly. This solves the problem that: when the mobile terminal is in a held-in-hand state, because the palm will contact the lower part of the side frame of the mobile terminal, there may be a relatively large loss of current flowing through the lower part of the side frame, which seriously affects the radiation efficiency of the antennas. By generating additional resonance at the slot between the side frame and the metal plate of the metal frame, the otherwise concentrated radiation signals are dispersed, thereby achieving the effects of reducing the radiation signal loss at the held part in a held-in-hand state of a mobile terminal and improving the radiation efficiency of the antenna assembly.

Figure 3:
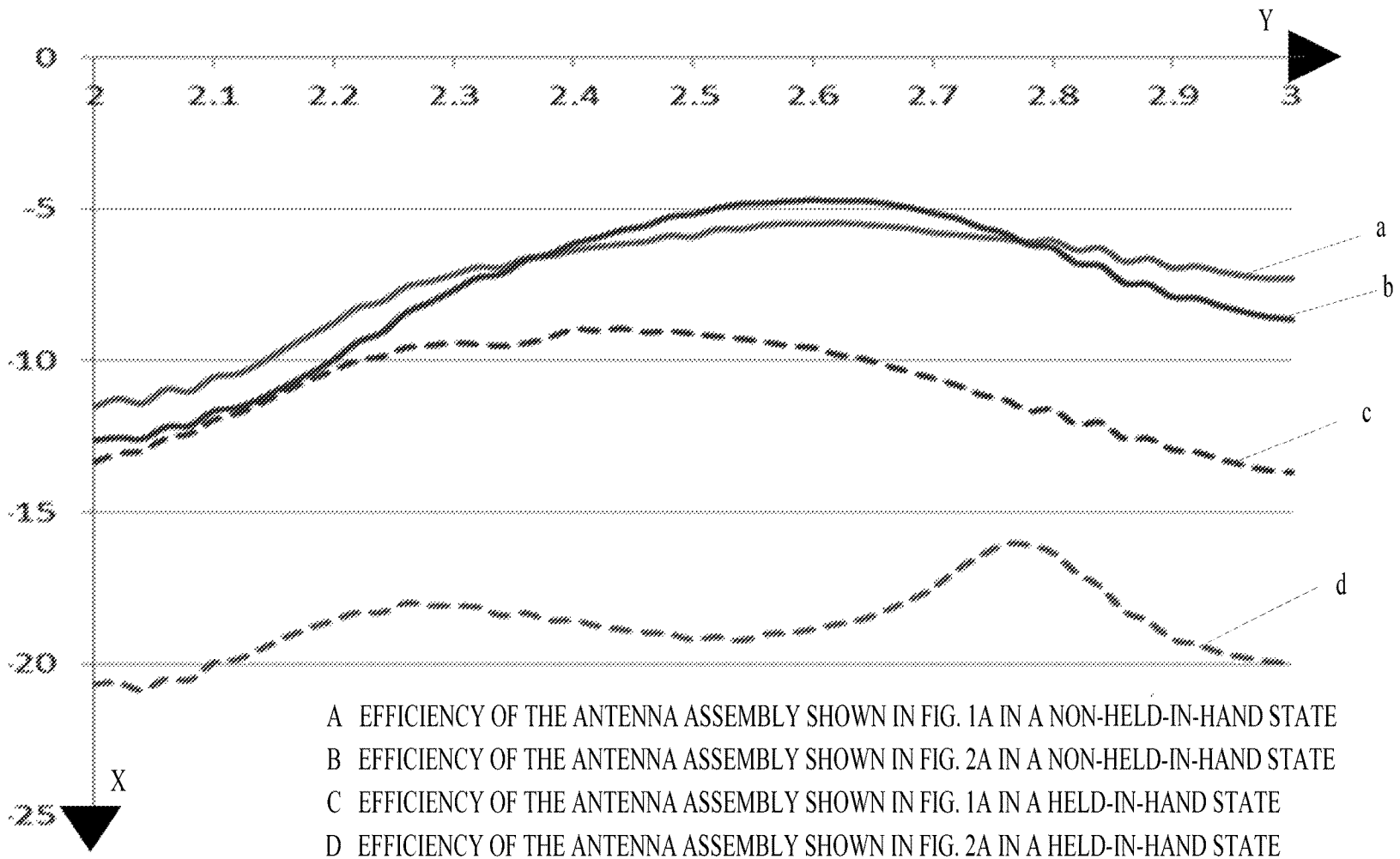
FIG. 3 is a diagram illustrating a comparison among radiation efficiencies of an antenna assembly provided in embodiments of this disclosure and radiation efficiencies of a conventional antenna assembly.

FIG. 3 is a diagram illustrating radiation efficiencies of the antenna assemblies shown in FIGS. 1A and 2A in a held-in-hand state and a non-held-in-hand state of a mobile terminal respectively. The X-axis represents the radiation efficiency (in unit of dB), and the Y-axis represents the working frequency of the antenna (in unit of GHz). As shown in FIG. 3, in the non-held-in-hand state, the radiation efficiencies of the antenna assemblies shown in FIGS. 1A and 2A are close to each other. However, in the held-in-hand state, compared with FIG. 1A in which the radiation signals are concentrated in the antenna assembly, the radiation signals are dispersedly distributed in the antenna assembly in FIG. 2A, so that the radiation signal attenuation amount caused by palm holding is reduced, thereby improving the overall radiation efficiency of the antenna assembly. In addition, the antenna assembly in FIG. 2A can utilize additional resonance produced at the slot, so that the radiation efficiency of the antenna assembly is further improved (compared with the antenna assembly in FIG. 1A, the radiation efficiency of the antenna assembly in FIG. 2A is increased by about 4 dB on average).

In sum, according to a first aspect of the embodiments of the present disclosure, there is provided an antenna assembly, including: a first antenna, a second antenna and a metal frame. The metal frame may include: a metal plate; and a first side frame, a second side frame, a top frame and a bottom frame which enclose the metal plate. The first antenna is connected to a first radiation part of the bottom frame via a first connection point, the first radiation part being connected to the first side frame which is separated from the metal plate by a slot. The second antenna is connected to a second radiation part of the bottom frame via a second connection point, the second radiation part being disconnected from the first radiation part and the second side frame.

Optionally, a first feed current flowing through the first antenna flows into the first radiation part via the first connection point, and flows into the first side frame and the metal plate via the first radiation part; the first radiation part is configured to radiate an antenna signal under the action of the first feed current, and the first side frame and the metal plate are configured to produce resonance at the slot under the action of the first feed current. A second feed current flowing through the second antenna flows into the second radiation part via the second connection point, and the second radiation part is configured to radiate an antenna signal under the action of the second feed current.

Optionally, a length of the slot is inversely proportional to a resonance frequency of the produced resonance.

Optionally, a width of the slot is proportional to a resonance bandwidth of the produced resonance.

Optionally, a length of the first radiation part is less than that of the second radiation part. The first radiation part is configured to radiate an antenna signal at a high frequency band, and the second radiation part is configured to radiate an antenna signal at a medium and low frequency band. The high frequency band ranges from 2,300 MHz to 2,700 MHz, and the medium and low frequency band ranges from 700 MHz to 2,100 MHz.

Optionally, a clearance area is provided between the bottom frame and the metal plate for radiating antenna signals.

According to a second aspect of the embodiments of the present disclosure, there is provided an electronic device including an antenna assembly according to the first aspect.

Optionally, the first and second antennas are connected to a printed circuit board (PCB) of the electronic device via their respective feed points, and the PCB is fixedly arranged in the metal frame.

According to a third aspect of the embodiments of the present disclosure, a method may be provided. The method may include: providing an antenna assembly that may include a first antenna, a second antenna and a metal frame, wherein: the metal frame may include: a metal plate; and a first side frame, a second side frame, a top frame and a bottom frame which enclose the metal plate; the first antenna is connected to a first radiation part of the bottom frame via a first connection point, the first radiation part being connected to the first side frame which is separated from the metal plate by a slot; and the second antenna is connected to a second radiation part of the bottom frame via a second connection point, the second radiation part being disconnected from the first radiation part and the second side frame.

The method may also include radiating, by the first radiation part, an antenna signal under the action of a first feed current that flows through the first antenna, flows into the first radiation part via the first connection point, and flows into the first side frame and the metal plate via the first radiation part; and radiating, by second radiation part, an antenna signal under the action of a second feed current that flows through the second antenna, flows into the second radiation part via the second connection point.

The method may further include producing, by the first side frame and the metal plate, resonance at the slot under the action of the first feed current.

The technical solutions according to the embodiments of this disclosure may have the following advantageous effects. By providing a slot between the metal plate of the metal frame and the side frame, additional resonance can be produced at the slot by the side frame and the metal plate under the action of the feed current flowed thereinto, thereby improving the radiation performance of the antenna assembly. This solves the problem that: when the mobile terminal is in a held-in-hand state, because the palm will contact the lower part of the side frame of the mobile terminal, there will be a relatively large loss of current flowing through the lower part of the side frame, which seriously affects the radiation efficiency of the antennas. By generating additional resonance at the slot between the side frame and the metal plate of the metal frame, the otherwise concentrated radiation signals are dispersed, thereby achieving the effects of reducing the radiation signal loss at the held part in a held-in-hand state of the mobile terminal and improving the radiation efficiency of the antenna assembly.

Other embodiments of the disclosure will be apparent to those skilled in the art from consideration of the specification and practice of the disclosure disclosed here. This application is intended to cover any variations, uses, or adaptations of the disclosure following the general principles thereof and including such departures from the present disclosure as come within known or customary practice in the art. It is intended that the specification and examples be considered as exemplary only, with a true scope and spirit of the disclosure being indicated by the following claims.

It will be appreciated that the present disclosure is not limited to the exact construction that has been described above and illustrated in the accompanying drawings, and that various modifications and changes can be made without departing from the scope thereof. It is intended that the scope of the disclosure only be limited by the appended claims.

The invention claimed is:

1. An antenna assembly, comprising: a first antenna, a second antenna and a metal frame, wherein the metal frame comprise: a metal plate; and a first side frame, a second side frame, a top frame and a bottom frame which enclose the metal plate;

the first antenna is connected to a first radiation part of the bottom frame via a first connection point, the first radiation part being connected to the first side frame which is separated from the metal plate by a slot, and the slot being opened on the metal frame between the first side frame and the metal plate; and the second antenna is connected to a second radiation part of the bottom frame via a second connection point, the second radiation part being disconnected from the first radiation part and the second side frame.

2. The antenna assembly of claim 1, wherein a first feed current flowing through the first antenna flows into the first radiation part via the first connection point, and flows into the first side frame and the metal plate via the first radiation part; the first radiation part is configured to radiate an antenna signal under an action of the first feed current, and the first side frame and the metal plate are configured to produce resonance at the slot under the action of the first feed current;

a second feed current flowing through the second antenna flows into the second radiation part via the second connection point, and the second radiation part is configured to radiate an antenna signal under an action of the second feed current.

3. The antenna assembly of claim 2, wherein a length of the slot is inversely proportional to a resonance frequency of the produced resonance.

4. The antenna assembly of claim 3, wherein a length of the first radiation part is less than that of the second radiation part;

the first radiation part is configured to radiate an antenna signal at a high frequency band, and the second radiation part is configured to radiate an antenna signal at a medium and low frequency band; and the high frequency band ranges from 2,300 MHz to 2,700 MHz, and the medium and low frequency band ranges from 700 MHz to 2,100 MHz.

5. The antenna assembly of claim 3, wherein a clearance area is provided between the bottom frame and the metal plate for radiating antenna signals.

6. The antenna assembly of claim 2, wherein a width of the slot is proportional to a resonance bandwidth of the produced resonance.

7. The antenna assembly of claim 6, wherein a length of the first radiation part is less than that of the second radiation part;

the first radiation part is configured to radiate an antenna signal at a high frequency band, and the second radiation part is configured to radiate an antenna signal at a medium and low frequency band; and the high frequency band ranges from 2,300 MHz to 2,700 MHz, and the medium and low frequency band ranges from 700 MHz to 2,100 MHz.

8. The antenna assembly of claim 6, wherein a clearance area is provided between the bottom frame and the metal plate for radiating antenna signals.

9. The antenna assembly of claim 2, wherein a length of the first radiation part is less than that of the second radiation part;

the first radiation part is configured to radiate an antenna signal at a high frequency band, and the second radiation part is configured to radiate an antenna signal at a medium and low frequency band; and the high frequency band ranges from 2,300 MHz to 2,700 MHz, and the medium and low frequency band ranges from 700 MHz to 2,100 MHz.

10. The antenna assembly of claim 2, wherein a clearance area is provided between the bottom frame and the metal plate for radiating antenna signals.

11. The antenna assembly of claim 1, wherein a length of the first radiation part is less than that of the second radiation part;

the first radiation part is configured to radiate an antenna signal at a high frequency band, and the second radiation part is configured to radiate an antenna signal at a medium and low frequency band; and the high frequency band ranges from 2,300 MHz to 2,700 MHz, and the medium and low frequency band ranges from 700 MHz to 2,100 MHz.

12. The antenna assembly of claim 1, wherein a clearance area is provided between the bottom frame and the metal plate for radiating antenna signals.

13. The antenna assembly of claim 1, wherein antenna radiation signals are dispersedly distributed over the first radiation part and the second side frame corresponding to the slot so that a radiation amount of the antenna signals in a unit length is reduced.

14. An electronic device comprising an antenna assembly that comprises a first antenna, a second antenna and a metal frame, wherein:

the metal frame comprises: a metal plate; and a first side frame, a second side frame, a top frame and a bottom frame which enclose the metal plate;

the first antenna is connected to a first radiation part of the bottom frame via a first connection point, the first radiation part being connected to the first side frame which is separated from the metal plate by a slot, and the slot being opened on the metal frame between the first side frame and the metal plate; and the second antenna is connected to a second radiation part of the bottom frame via a second connection point, the second radiation part being disconnected from the first radiation part and the second side frame.

15. The electronic device of claim 14, wherein the first and second antennas are connected to a printed circuit board (PCB) of the electronic device via their respective feed points, and the PCB is fixedly arranged in the metal frame.

16. The electronic device of claim 14, wherein antenna radiation signals are dispersedly distributed over the first radiation part and the second side frame corresponding to the slot so that a radiation amount of the antenna signals in a unit length is reduced.

17. A method, comprising:

providing an antenna assembly that comprises a first antenna, a second antenna and a metal frame, wherein:

the metal frame comprises: a metal plate; and a first side frame, a second side frame, a top frame and a bottom frame which enclose the metal plate;

the first antenna is connected to a first radiation part of the bottom frame via a first connection point, the first radiation part being connected to the first side frame which is separated from the metal plate by a slot, and the slot being opened on the metal frame between the first side frame and the metal plate; and the second antenna is connected to a second radiation part of the bottom frame via a second connection point, the second radiation part being disconnected from the first radiation part and the second side frame;

radiating, by the first radiation part, an antenna signal under an action of a first feed current that flows through the first antenna, flows into the first radiation part via the first connection point, and flows into the first side frame and the metal plate via the first radiation part; and radiating, by the second radiation part, an antenna signal under an action of a second feed current that flows through the second antenna, and flows into the second radiation part via the second connection point.

18. The method of claim 17, further comprising:

producing, by the first side frame and the metal plate, resonance at the slot under the action of the first feed current.

19. The method of claim 17, wherein antenna radiation signals are dispersedly distributed over the first radiation part and the second side frame corresponding to the slot so that a radiation amount of the antenna signals in a unit length is reduced.

* * * * *